US009203173B2

(12) United States Patent
Wang

(10) Patent No.: US 9,203,173 B2
(45) Date of Patent: Dec. 1, 2015

(54) SLIDABLE BUTTON ASSEMBLY AND ELECTRONIC DEVICE USING SAME

(71) Applicant: Chi Mei Communication Systems, Inc., New Taipei (TW)

(72) Inventor: Min-Sheng Wang, New Taipei (TW)

(73) Assignee: Chi Mei Communications Systems, Inc., New Taipei (TW)

( * ) Notice: Subject to any disclaimer, the term of this patent is extended or adjusted under 35 U.S.C. 154(b) by 182 days.

(21) Appl. No.: 13/947,671

(22) Filed: Jul. 22, 2013

(65) Prior Publication Data

US 2014/0065860 A1 Mar. 6, 2014

(30) Foreign Application Priority Data

Aug. 31, 2012 (TW) ..... 101216728 U

(51) Int. Cl.
*H01R 13/44* (2006.01)
*H01R 13/447* (2006.01)

(52) U.S. Cl.
CPC ..... *H01R 13/447* (2013.01)

(58) Field of Classification Search
CPC ..... H01R 13/447
See application file for complete search history.

(56) References Cited

U.S. PATENT DOCUMENTS

| | | | | |
|---|---|---|---|---|
| 5,301,494 | A * | 4/1994 | Peot et al. | 56/10.5 |
| 5,701,232 | A * | 12/1997 | Tang et al. | 361/679.58 |
| 6,652,297 | B1 * | 11/2003 | Zhang et al. | 439/136 |
| 7,307,846 | B2 * | 12/2007 | Du | 361/728 |
| 8,213,162 | B2 * | 7/2012 | Huang | 361/679.01 |
| 8,446,125 | B2 * | 5/2013 | Mkhitarian | 320/112 |
| 2010/0053851 | A1 * | 3/2010 | Bernstein et al. | 361/679.01 |
| 2010/0072041 | A1 * | 3/2010 | Zuo | 200/17 R |
| 2010/0279527 | A1 * | 11/2010 | Liu | 439/136 |
| 2010/0309613 | A1 * | 12/2010 | Zuo et al. | 361/679.01 |
| 2014/0065860 | A1 * | 3/2014 | Wang | 439/136 |
| 2014/0118905 | A1 * | 5/2014 | Chung et al. | 361/679.01 |

* cited by examiner

*Primary Examiner* — James Harvey
(74) *Attorney, Agent, or Firm* — Novak Druce Connolly Bove + Quigg LLP

(57) ABSTRACT

A slidable assembly for an electronic device includes a housing, a slidable button, and a stopper. The housing defines a receiving groove, a slot, and a plurality of ports. The slidable button is slidably received in the receiving groove, and includes a seal ring for sealing the plurality of ports. The stopper is attached to the slot of the housing for abutting one side of the slidable button and stopping the slidable button from sliding out of the receiving groove. The slidable button is slid in the receiving groove to expose or cover the plurality of ports.

11 Claims, 6 Drawing Sheets

SLIDABLE BUTTON ASSEMBLY AND ELECTRONIC DEVICE USING SAME

BACKGROUND

1. Technical Field

The present disclosure relates to slidable button assemblies, and particularly to a slidable button assembly used in an electronic device.

2. Description of Related Art

Many portable electronic devices, such as mobile phones, have a housing defining an interior compartment for receiving a plurality of electronic components. The devices often include a slidable button assembly on one side of the housing for one-handed operation of the device. However, the slidable button assembly is located in a space defined in an outer shell of the portable electronic device, with a slight gap defined between the slidable button assembly and the outer shell. Dust/water can easily enter into the portable electronic device through the gap.

Therefore, there is room for improvement within the art.

BRIEF DESCRIPTION OF THE DRAWINGS

Many aspects of the slidable button assembly can be better understood with reference to the following drawings. The components in the drawings are not necessarily drawn to scale, the emphasis instead being placed upon clearly illustrating the principles of the slidable button assembly. Moreover, in the drawings, like reference numerals designate corresponding parts throughout the several views.

DETAILED DESCRIPTION

The disclosed slidable button assembly may be used for protecting ports (e.g., power port, earpiece port, or USB port) of portable electronic devices such as mobile phones or personal digital assistants, in accordance with an exemplary embodiment. In the exemplary embodiment, the slidable button assembly used in a mobile phone is illustrated, although the disclosure is not limited thereto.

Figure 1:
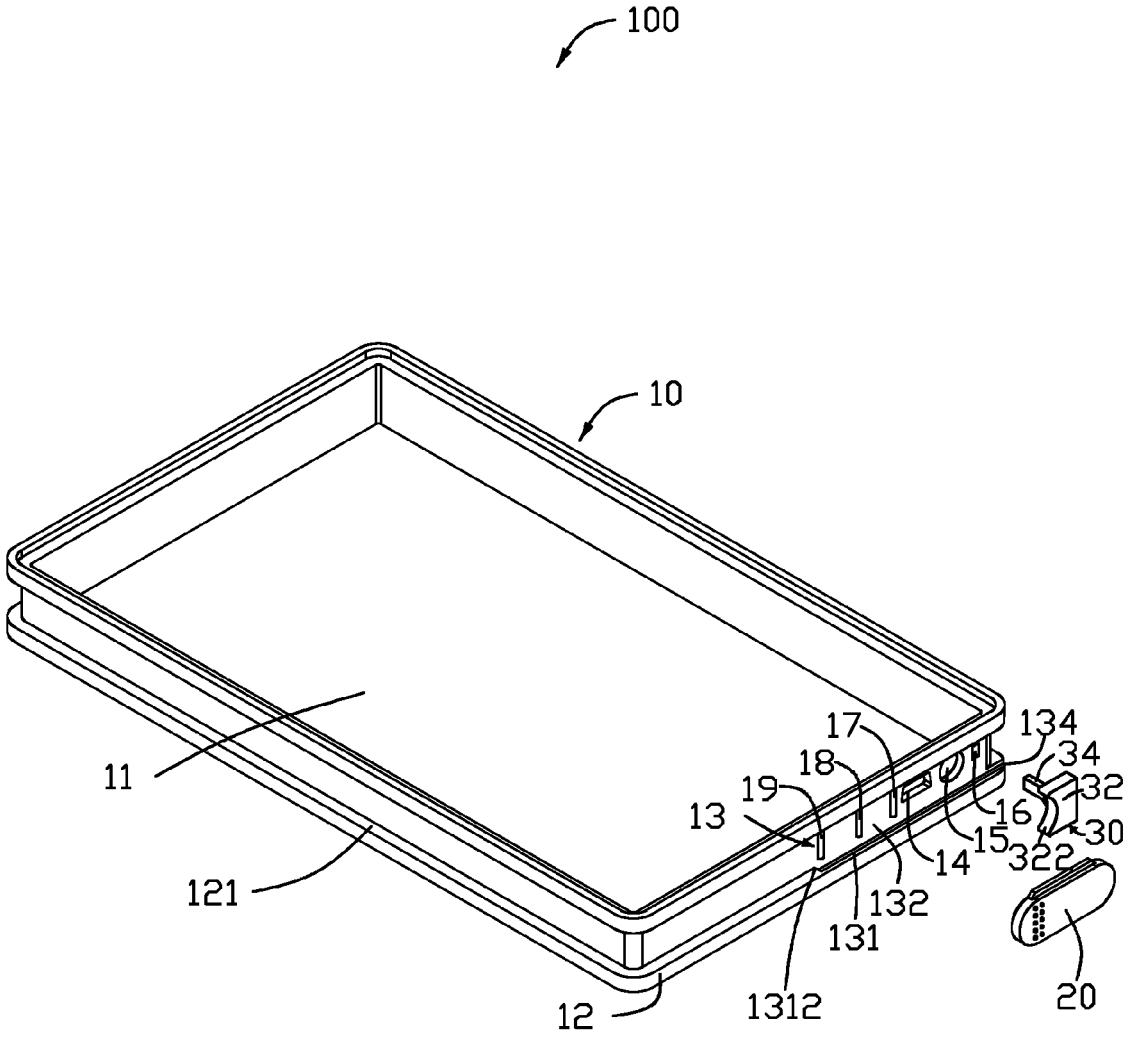
FIG. 1 is an exploded view of a portion of a portable electronic device using a slidable button assembly, in accordance with an exemplary embodiment.
Figure 2:
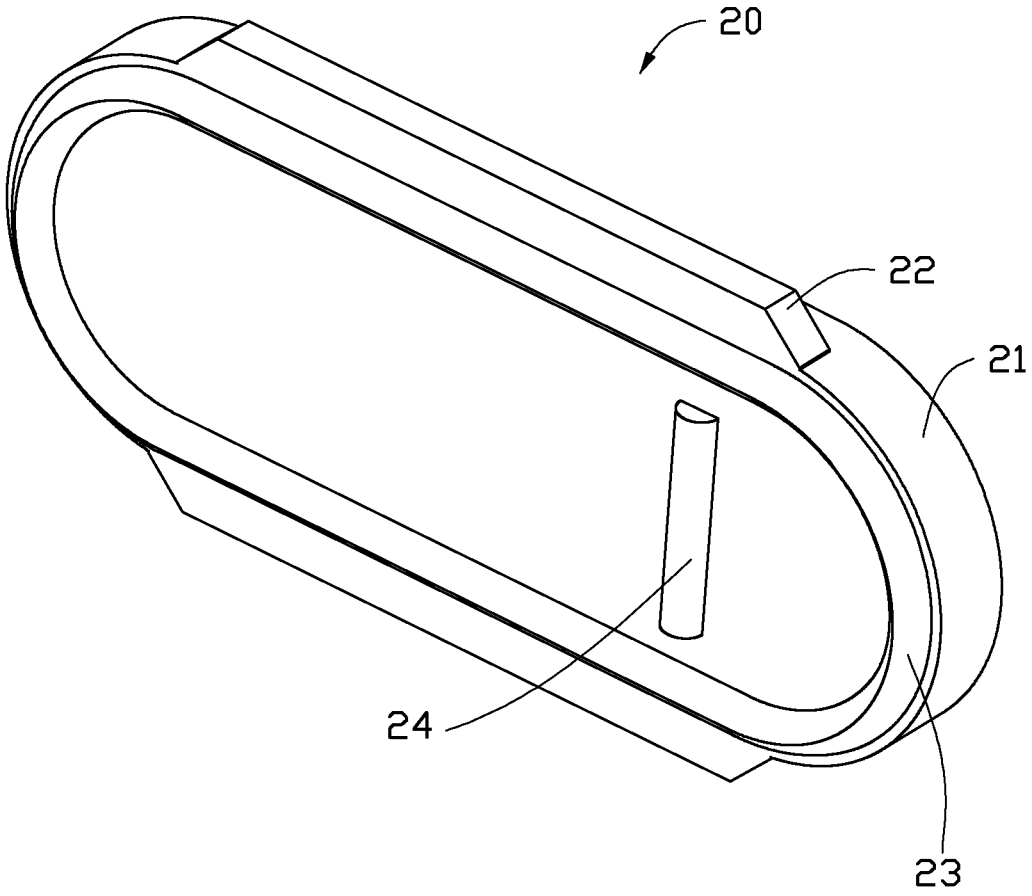
FIG. 2 is an enlarged view of a slidable button shown in FIG. 1.
Figure 3:
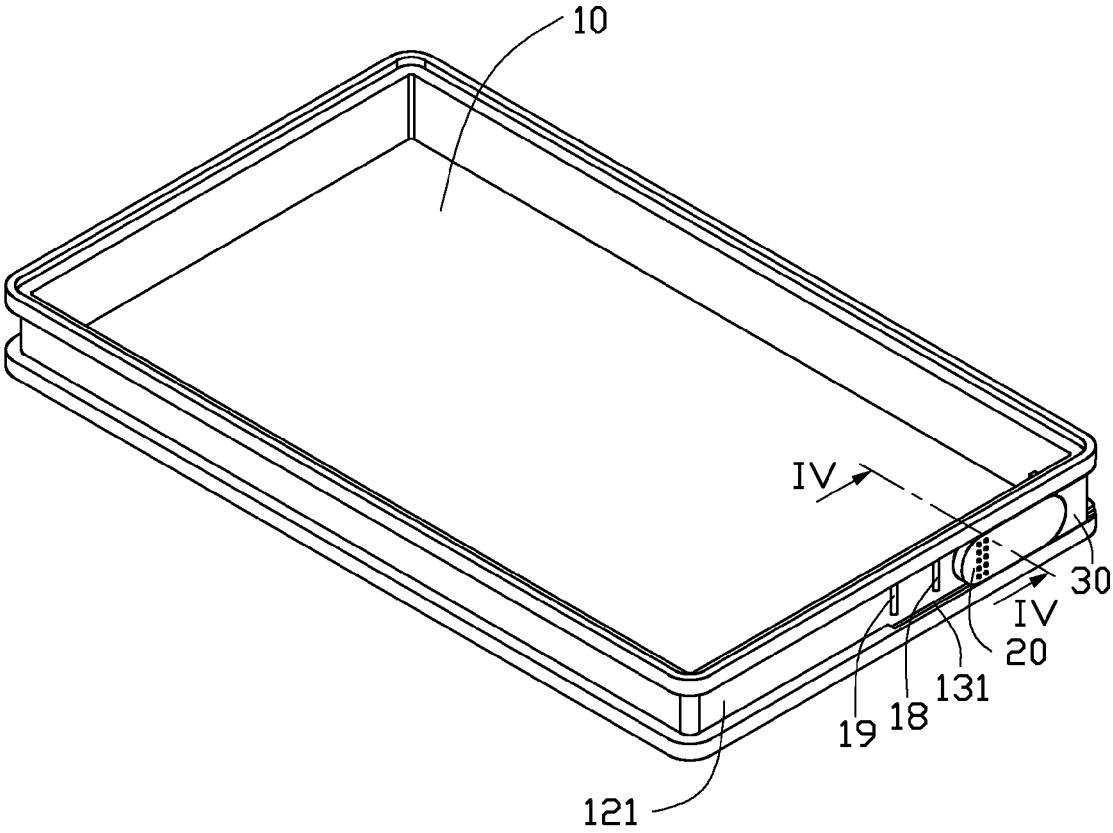
FIG. 3 is a schematic view of the portable electronic device of FIG. 1.

FIGS. 1 to 3 show a portable electronic device 100 includes a housing 10, a slidable button 20, and a stopper 30.

The housing 10 (only a portion of which is shown) includes a base plate 11 and a peripheral wall 12 connected substantially perpendicularly to the base plate 11. A groove 121 is defined in the peripheral wall 12 and extends continuously around all sides of the peripheral wall 12. A receiving groove 13 is located in a section of the groove 121. The receiving groove 13 is coplanar with the groove 121. The receiving groove 13 has two opposite extending edges 131 and a groove surface 132. A first port 14 and a second port 15 are defined in the groove surface 132. In this exemplary embodiment, the first port 14 is a USB port, and the second port 15 is a power port or an earpiece port. A slot 16 is defined adjacent to one side of the second port 15 for latching the stopper 30. A first rib 17, a second rib 18, and a third rib 19 are formed adjacent to the first port 14. In this exemplary embodiment, the first rib 17, the second rib 18, and the third rib 19 are spaced equidistantly from each other. The first rib 17 is adjacent to the first port 14. The receiving groove 13 has an entrance 134 to allow the slidable button 20 to slide into the receiving groove 13. Each extending edge 131 has a sloping surface 1312 for abutting one end of the slidable button 20.

Referring to FIG. 2, the slidable button 20 includes a button body 21. Two rails 22 extend from opposite sides of the button body 21. A seal ring 23 and a latching block 24 are located on one surface of the button body 21. The seal ring 23 is formed around the latching block 24 and is made of thermoplastic material, such as thermoplastic polyurethane. In this exemplary embodiment, the seal ring 23 is integrally formed with the button body 21 by dual-injection molding. The seal ring 23 prevents dust/water from entering the first port 14 or the second port 15.

The stopper 30 is made of elastic material, such as rubber, and includes a plate portion 32 and a latching arm 34. The latching arm 34 extends substantially perpendicularly from the plate portion 32. The latching arm 34 has two protrusions 342. A width of the plate portion 32 is substantially the same as a distance between the two extending edges 131. The plate portion 32 has an arcuate surface 322 configured for engaging with one end of the slidable button 20. When the stopper 30 is attached to the housing 10, the latching arm 34 extends through the slot 16 and allows the protrusions 342 to deformedly pass through the slot 16 for preventing the latching arm 34 from separating from the housing 10.

Figure 4:
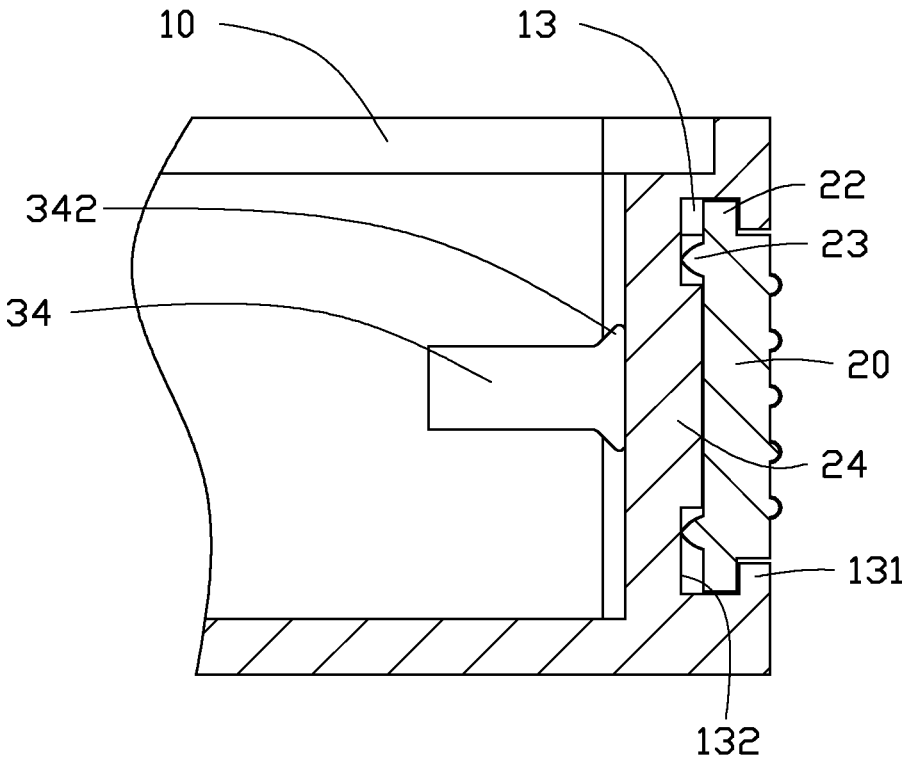
FIG. 4 is a cross-sectional view of the portable electronic device taken along line IV-IV.
Figure 5:
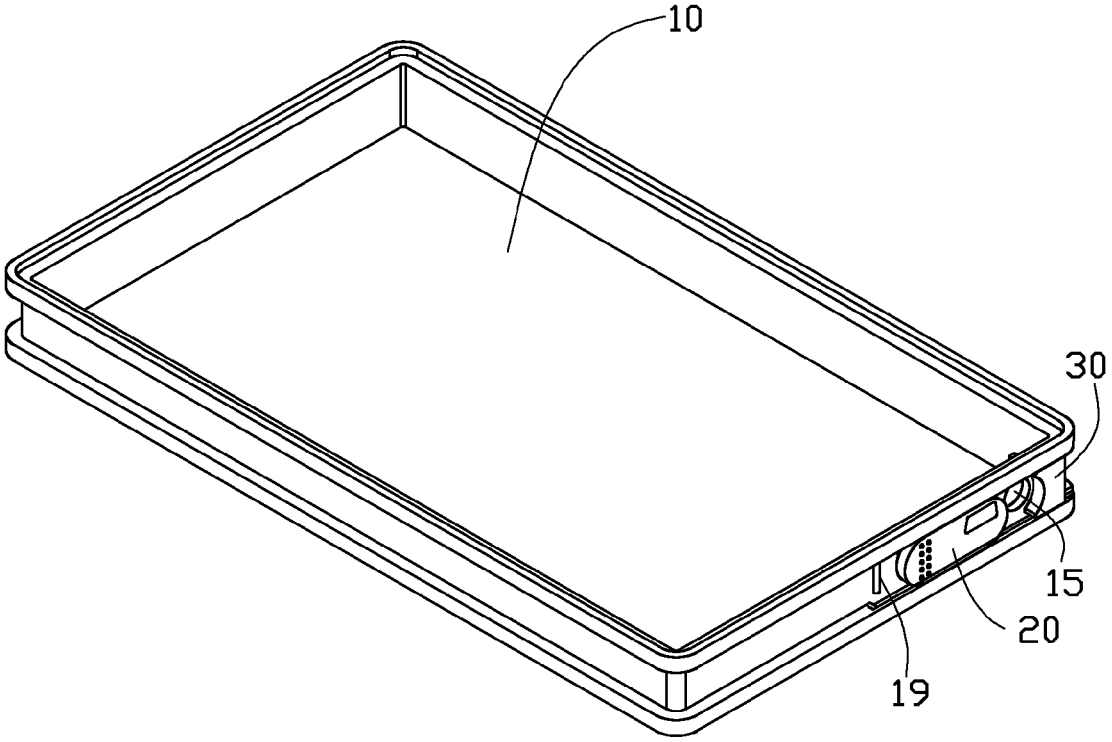
FIGS. 5 and 6 show different states of the portable electronic device in use.
Figure 6:
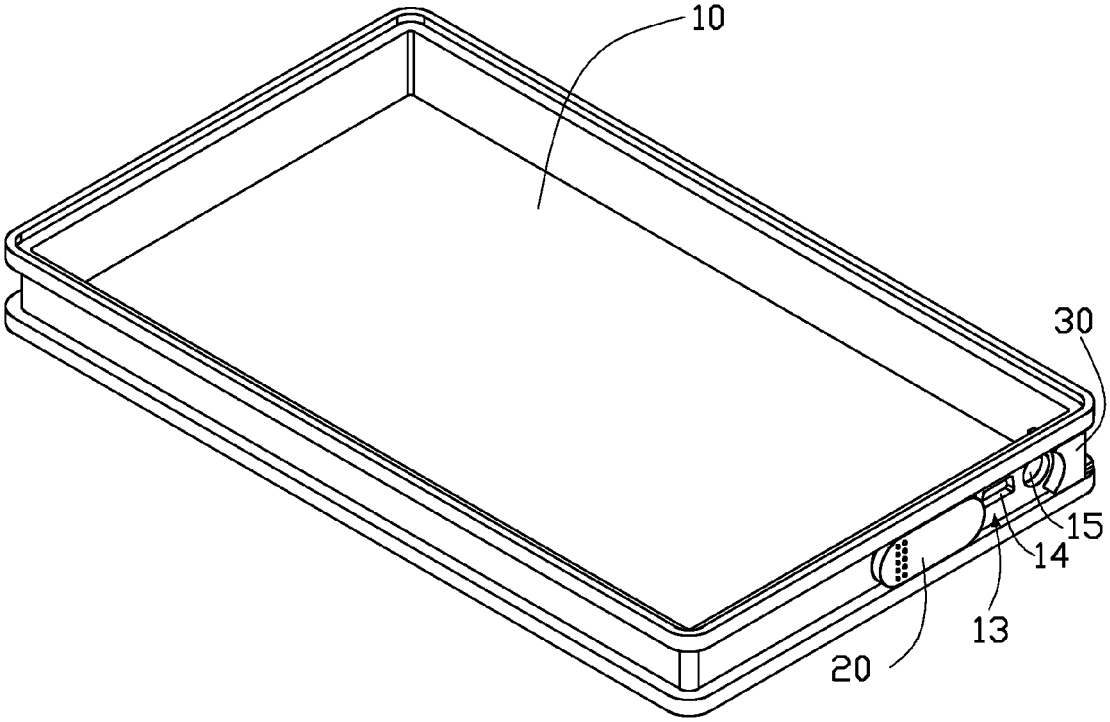

Referring to FIGS. 3 and 4, during assembly, the rails 22 of the slidable button 20 are slid in the receiving groove 13 from the entrance 134, and the extending edges 131 prevent the rails 22 from separating from the receiving groove 13. The slidable button 20 is slid until the slidable button 20 completely covers the first port 14 and the second port 15. The first rib 17 latches with the latching block 24. Then, the stopper 30 is assembled to the housing 10 via the latching arm 34. The seal ring 23 surrounds the first port 14 and the second port 15 for sealing the first port 14 and the second port 15.

In use, the slidable button 20 is slid in the receiving groove 13 toward the second rib 18 until the latching block 24 passes over the first rib 17 and abuts against the second rib 18. At this time, the slidable button 20 is positioned in a first position, and the second port 15 is exposed for use. The seal ring 23 surrounds the first port 14 for preventing dust/water from passing through the first port 14. If the first port 14 and the second port 15 are needed for use, the slidable button 20 is further slid in the receiving groove 13 toward the third rib 19 until the latching block 24 passes over the second rib 18 and abuts against the third rib 19. The rails 22 are stopped by the sloping surface 1312. Thus, the slidable button 20 is positioned in a second position, and the first port 14 and the second port 15 are exposed for use.

It is to be understood, however, that even through numerous characteristics and advantages of the present disclosure have been set forth in the foregoing description, together with details of assembly and function, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A slidable button assembly for an electronic device, comprising:

a housing comprising a receiving groove, a slot, and a plurality of ports;

a slidable button slidably positioned in the receiving groove, the slidable button including a seal ring for sealing the plurality of ports; and a stopper attached to the slot of the housing for abutting against one end of the slidable button;

wherein the slidable button is slid in the receiving groove to expose or cover the plurality of ports;

wherein the slidable button comprises a button body and two rails extending from opposite sides of the button body, the button body covers the plurality of ports and the rails slide along the receiving groove.

2. An electronic device comprising:

a housing defining a receiving groove, the receiving groove having two opposite extending edges and a groove surface, a plurality of ribs and a plurality of ports located in the groove surface;

a slidable button slidably positioned in the receiving groove, the slidable button including a latching block, the latching block selectively engages with one of a first rib, a second rib and a third rib for positioning the slidable button in different positions; and a stopper attached to the housing for abutting one end of the slidable button;

wherein the slidable button is slid in the receiving groove to expose or cover the plurality of ports.

3. The slidable button assembly as claimed in claim 1, wherein a latching block is located on one surface of the button body, and the seal ring is around the latching block.

4. The slidable button assembly as claimed in claim 3, wherein the seal ring is made of thermoplastic polyurethane, and is integrally formed with the button body by dual-injection molding.

5. The slidable button assembly as claimed in claim 1, wherein the stopper comprises a plate portion and a latching arm, the latching arm perpendicularly extends from the plate portion, the latching arm has two protrusions, the two protrusions deformedly pass through the slot to assemble the stopper to the housing.

6. The slidable button assembly as claimed in claim 5, wherein the plate portion has an arcuate surface for abutting another end of the slidable button.

7. The slidable button assembly as claimed in claim 1, wherein the receiving groove has two opposite extending edges and a groove surface, the plurality of ports are defined in the groove surface, each extending edge has a sloping surface for abutting another end of the slidable button.

8. The slidable button assembly as claimed in claim 1, wherein the slidable button has a latching block, a first rib, a second rib and a third rib are formed on the receiving groove, the latching block selectively engages with one of the first rib, the second rib and the third rib for positioning the slidable button in different positions.

9. The electronic device as claimed in claim 2, wherein each extending edge has a sloping surface for abutting another end of the slidable button.

10. The electronic device as claimed in claim 9, wherein the stopper comprises a plate portion and a latching arm, the latching arm extends substantially perpendicularly from the plate portion, the latching arm has two protrusions, the two protrusions deformedly pass through the slot to assemble the stopper to the housing.

11. The electronic device as claimed in claim 10, wherein the slidable button comprises a button body and two rails extending from opposite sides of the button body, the button body covers the plurality of ports, and the rails slide along the receiving groove.

* * * * *